US009858784B2

(12) United States Patent
Peeters et al.

(10) Patent No.: US 9,858,784 B2
(45) Date of Patent: Jan. 2, 2018

(54) BATTERY-POWERED DEVICE HAVING A BATTERY AND LOUD SOUND DETECTOR USING PASSIVE SENSING

(71) Applicant: Roost, Inc., Sunnyvale, CA (US)

(72) Inventors: Roel Peeters, San Carlos, CA (US); James Blackwell, Los Gatos, CA (US)

(73) Assignee: Roost, Inc., Sunnyvale, CA (US)

( * ) Notice: Subject to any disclaimer, the term of this patent is extended or adjusted under 35 U.S.C. 154(b) by 0 days.

(21) Appl. No.: 14/501,011

(22) Filed: Sep. 29, 2014

(65) Prior Publication Data

US 2016/0093200 A1 Mar. 31, 2016

(51) Int. Cl.

| | |
|---|---|
| ***G08B 17/10*** | (2006.01) |
| ***G08B 1/08*** | (2006.01) |
| ***G08B 29/18*** | (2006.01) |
| ***G08B 25/10*** | (2006.01) |
| *G08B 17/113* | (2006.01) |

(52) U.S. Cl.

CPC ..... *G08B 17/10* (2013.01); *G08B 1/08* (2013.01); *G08B 25/10* (2013.01); *G08B 29/181* (2013.01); *G08B 17/113* (2013.01)

(58) Field of Classification Search

CPC ..... G08B 25/10; G08B 17/10; G04G 11/00; G04G 13/02; G04G 13/026; A61B 5/11; A61B 5/4812

See application file for complete search history.

(56) References Cited

U.S. PATENT DOCUMENTS

| | | | | |
|---|---|---|---|---|
| 5,895,728 | A | 4/1999 | Walker et al. | |
| 6,150,943 | A | 9/2000 | Lehman et al. | |
| 7,015,807 | B2 * | 3/2006 | Roby | G08B 1/08 340/511 |
| 8,558,708 | B2 | 10/2013 | Albert et al. | |
| 9,070,263 | B1 | 6/2015 | Peeters et al. | |
| 2003/0122523 | A1 | 7/2003 | Kim et al. | |
| 2004/0108856 | A1 * | 6/2004 | Johnson | G01R 31/3668 324/426 |
| 2006/0082455 | A1 * | 4/2006 | Andres | G08B 7/06 340/539.1 |
| 2007/0146127 | A1 | 1/2007 | Stilp et al. | |

(Continued)

FOREIGN PATENT DOCUMENTS

EP 0780915 A1 6/1997

OTHER PUBLICATIONS

International Search Report and Written Opinion in International Patent Application No. PCT/US2015/039312, dated Jan. 15, 2016, 12 pages.

(Continued)

*Primary Examiner* — Orlando Bousono

(74) *Attorney, Agent, or Firm* — Davis Wright Tremaine LLP; Phillip H. Albert

(57) ABSTRACT

A communication device comprises a processing circuit having at least two modes, a sleep mode and an awake mode, a wireless communications circuit that can wirelessly send a message as to whether an alarm has been triggered, and a passive sensor, powered by audio signals impinging on the passive sensor, that provides at least an approximation of an audio signal to the processing circuit so as to cause the processing circuit to switch between the at least two modes. The communication device can be housed in a housing sized to fit into a battery compartment.

5 Claims, 1 Drawing Sheet

(56) References Cited

U.S. PATENT DOCUMENTS

2007/0200720 A1 8/2007 Drieskemper et al.
2008/0157956 A1* 7/2008 Radivojevic ..... A61B 5/11 340/531
2009/0279392 A1* 11/2009 Scott ..... G04G 9/00 368/72
2009/0284389 A1* 11/2009 Klassen ..... G04G 11/00 368/10
2010/0052613 A1* 3/2010 Leung ..... H02J 7/0045 320/114
2010/0057406 A1 3/2010 Smout
2010/0085840 A1* 4/2010 Lazaridis ..... G04G 13/02 368/10
2010/0085841 A1* 4/2010 Lazaridis ..... G04G 13/026 368/73
2010/0085842 A1* 4/2010 Lazaridis ..... G04G 13/026 368/73
2010/0102971 A1* 4/2010 Virtanen ..... A61B 5/11 340/575
2010/0230606 A1 9/2010 Liu et al.
2010/0279745 A1* 11/2010 Westcott ..... H04W 52/0274 455/574
2011/0193713 A1* 8/2011 Albert ..... G08B 3/10 340/635
2011/0300433 A1 12/2011 Kim
2012/0114983 A1 5/2012 Stokes et al.
2013/0002421 A1* 1/2013 Lazaridis ..... G04G 13/026 340/527
2013/0135097 A1* 5/2013 Doezema ..... G08B 21/0446 340/539.13
2013/0214730 A1* 8/2013 Lu ..... H02J 7/007 320/107
2013/0225127 A1* 8/2013 Cavacuiti ..... H04M 1/67 455/411
2013/0325190 A1 12/2013 Imes et al.
2014/0112226 A1* 4/2014 Jafarian ..... H04W 52/0229 370/311
2015/0018643 A1* 1/2015 Cole ..... A61B 5/0015 600/316
2015/0032412 A1* 1/2015 Chizhevskiy ..... G01S 17/00 702/158
2015/0173674 A1* 6/2015 Hayes ..... A61B 5/681 600/301

OTHER PUBLICATIONS

Peeters et al., "Battery-Powered Device Having a Battery and Loud Sound Detector Using Passive Sensing," U.S. Appl. No. 14/728,727, filed Jun. 2, 2015, 11 pages.

* cited by examiner

BATTERY-POWERED DEVICE HAVING A BATTERY AND LOUD SOUND DETECTOR USING PASSIVE SENSING

FIELD

The present disclosure relates generally to adding communications capability and sensing capability into battery-powered devices not having a native communications capability, more specifically, for sensing and reporting status.

BACKGROUND

Many devices that did not traditionally have communications capabilities are being replaced by updated devices that do have native communications capabilities. For example, newer, more expensive smoke detectors have native communications capabilities. However, this does not help with other smoke detectors and it is typically more cost effective to reuse the existing smoke detector and add in communications capabilities.

In adding such functionality, cost of components and assembly are a consideration. Another consideration is power consumption, as in a normal lifetime of smoke detector battery, only a very small portion of that lifetime is spent in an alarm activated state.

SUMMARY

A communication device comprises a processing circuit having at least two modes, a sleep mode and an awake mode, a wireless communications circuit that can wirelessly send a message as to whether an alarm has been triggered, and a passive sensor, powered by audio signals impinging on the passive sensor, that provides at least an approximation of an audio signal to the processing circuit so as to cause the processing circuit to switch between the at least two modes. The communication device can be housed in a housing sized to fit into a battery compartment.

The following detailed description together with the accompanying drawings will provide a better understanding of the nature and advantages of the present invention.

DETAILED DESCRIPTION

Figure 1:
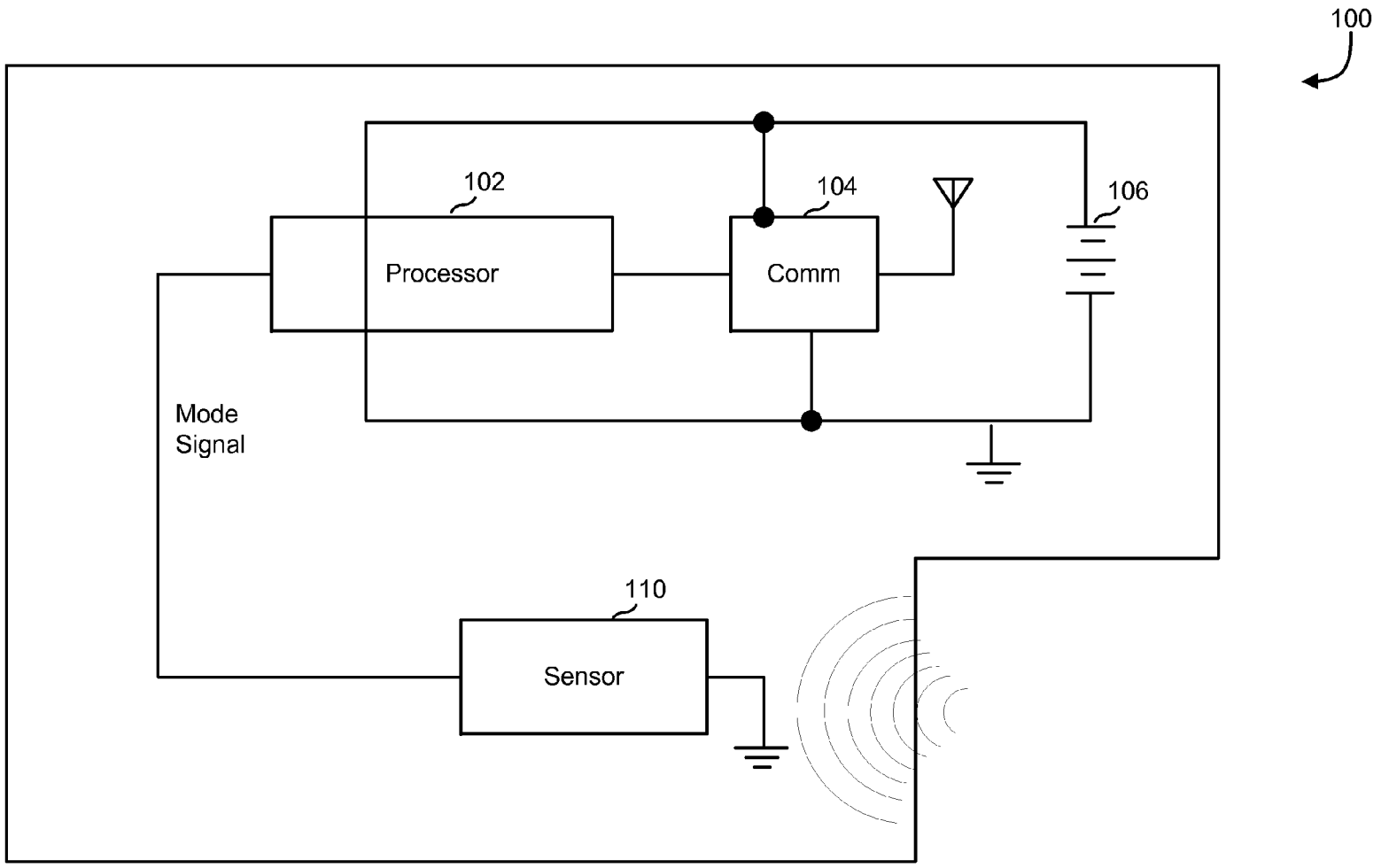
FIG. 1 illustrates a novel battery-based device with integrated audio sensing using a passive sensor.

For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

In embodiments of devices explained herein, sensing of an alarm activated state is done using a passive device thereby eliminating or reducing the amount of energy consumed for sensing while the activated state is not present. One approach to sensing an audio input is to use a microphone, such as a small electric microphone, listen for inputs—often by running a microprocessor that executes instructions including instructions to process inputs received from the microphone to determine if an appropriate audio input is occurring. This, however, can waste power.

FIG. 1 is a schematic diagram showing various components as might be used. As shown there, a device 100 includes a processor 102, a communications module 104 (which might comprise an antenna and/or some control logic and analog circuit elements), a battery 106 for powering processor 102 and communications module 104. In other variations, processor 102 is replaced with a simpler control circuit. Processor 102 can be a microprocessor or microcontroller or system on a chip, as appropriate.

Battery 106 might be integrated into a housing such that all of device 100 would fit into a chamber sized to accept a conventional battery. Preferably, processor 102 has a sleep mode and an awake mode, wherein power consumption is reduced in the sleep mode relative to the awake mode. Processor 102 switches from the sleep mode to the awake mode in response to a signal received at a mode signal input to processor 102. A passive sensor 110 is coupled to the mode signal input of processor 102.

Passive sensor 110 might comprise a piezoelectric transducer, such as those used as electrically powered output devices that generate audio. Given the location of device 100 (inside or near a smoke detector or other alarm signaling device), the typical minimum sound level requirement for such detector/devices, and the form of the signal, the sound energy impinging on passive sensor 110 in an alarm condition is sufficient energy to generate the mode signal without needing any other electrical power.

By taking advantage of the piezoelectric property that the transducer can generate a voltage when excited by an audio signal, and the minimum sound levels expected at passive sensor 110, as well as the level of detail needed from the signal, device 100 can remain in its deepest sleep state, without the need to periodically wake-up to monitor the audio.

In a specific embodiment, a smoke detector has a speaker that can generate an 85 dB alarm sound. Given the proximity of device 100 to the speaker, passive sensor 110 can generate enough excitation energy on its own to provide the mode signal, a voltage waveform that wakes processor 102. Once awake, processor 102 can monitor both the frequency and waveform period to determine if the cause of the wake-up was a real alarm. For example, processor 102 might maintain a set of lookup parameters that are compared to a continuing signal received at its mode signal input.

For ease of implementation, passive sensor 110 might be an audio transducer selected to have a resonant frequency close to, or at, the generated frequency of the alarm to increase the amplitude of the resulting output voltage waveform.

For many smoke detectors, the frequency and waveform of its audible alert is standard, such as those defined by ANSI specification ANSI/ASA S3.41-1990 (R2008) (Audible Emergency Evacuation Signal). ANSI specification ANSI/ASA S3.41-1990 (R2008) requires a specific pattern—referred to as "Temporal Three's". This pre-defined pattern can be used to validate that the alarm is being generated by the smoke alarm.

To minimize false triggers, the period and the frequency of the alarm can be learned during an installation process. As part of the installation, the user might be requested to press an alarm "test" button. This would trigger the smoke alarm and processor 102 can use passive sensor 110 to learn both the frequency and pattern of the alarm. Later, this can be used as a base comparison to compare against any future alarms. Thus, if there were a match, processor 102 would send an alarm signal to communication module 104, which could then wirelessly transmit a corresponding message signaling the alarm.

The device might also be used in other applications, such as a carbon monoxide detector or other alarm condition signaling system. The device might be used with various battery form factors, such as 9V, AA, AAA, ½ AA, N, or other form factors.

Using the above concepts, users of devices and sellers of such devices or sellers of combined battery/communications elements might have the systems set up so that alarm conditions can be detected without significant quiescent power drain.

The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Further embodiments can be envisioned to one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, while the invention has been described with respect to exemplary embodiments, one skilled in the art will recognize that numerous modifications are possible.

For example, the processes described herein may be implemented using hardware components, software components, and/or any combination thereof. The specification and drawings are, accordingly, to be regarded in an illustrative rather than a restrictive sense. It will, however, be evident that various modifications and changes may be made thereunto without departing from the broader spirit and scope of the invention as set forth in the claims and that the invention is intended to cover all modifications and equivalents within the scope of the following claims.

All references, including publications, patent applications, and patents, cited herein are hereby incorporated by reference to the same extent as if each reference were individually and specifically indicated to be incorporated by reference and were set forth in its entirety herein.

What is claimed is:

1. A device, configured for mounting in a battery compartment of an alarm signaling device having an alarm generator, comprising:

a housing sized to fit in the battery compartment;

a processing circuit, contained within the housing, having at least two modes, a sleep mode and an awake mode, wherein power consumption of the processing circuit is reduced in the sleep mode relative to the awake mode; and a passive sensor, contained within the housing, that, when the device is mounted in the battery compartment, is in proximity to an alarm generator of the alarm signaling device such that the passive sensor is powered by audio signals, generated by the alarm signaling device, impinging on the passive sensor without needing any other electrical power, the impinging providing at least an approximation of an audio signal to the processing circuit so as to cause the processing circuit to switch between the at least two modes.

2. The device of claim 1, wherein the alarm signaling device is a carbon monoxide detector.

3. The device of claim 1, wherein the alarm signaling device is a smoke detector.

4. The device of claim 1, wherein the passive sensor is a piezoelectric transducer.

5. The device of claim 1, wherein the passive sensor is an audio transducer with a resonant frequency at a generated frequency of an alarm.

* * * * *